US005389334A

United States Patent [19]

Culling

[11] Patent Number: 5,389,334

[45] Date of Patent: Feb. 14, 1995

[54] ABRASION AND CORROSION RESISTANT ALLOYS

[76] Inventor: John H. Culling, P.O. Box 769, Pevely, Mo. 63070-0769

[21] Appl. No.: 51,633

[22] Filed: Apr. 22, 1993

[51] Int. Cl.[6] ..... C22C 30/00

[52] U.S. Cl. ..... 420/582; 420/586.1

[58] Field of Search ..... 420/582, 587, 586.1; 148/419, 442

[56] References Cited

U.S. PATENT DOCUMENTS

| | | | |
|---|---|---|---|
| 3,758,296 | 9/1973 | Johnson . | |
| 4,050,928 | 9/1977 | Crum | 148/442 |
| 4,063,934 | 12/1977 | Thuillier et al. . | |
| 4,080,198 | 3/1978 | Heyer et al. . | |
| 4,410,489 | 10/1983 | Asphahani et al. | 420/453 |
| 4,536,232 | 8/1985 | Khandros et al. . | |
| 5,082,625 | 1/1992 | Kato et al. | 420/453 |

FOREIGN PATENT DOCUMENTS

| | | | |
|---|---|---|---|
| 47-31205 | 8/1972 | Japan | 420/49 |
| 59-38365 | 3/1984 | Japan | 420/49 |
| 0143050 | 8/1984 | Japan | 420/49 |
| 708820 | 5/1954 | United Kingdom | 420/582 |
| 805187 | 12/1958 | United Kingdom | 420/582 |
| 1440362 | 6/1976 | United Kingdom | 420/49 |
| 565073 | 8/1977 | U.S.S.R. . | |

OTHER PUBLICATIONS

Niu Hong-jun et al., Heat-Resisting Materials, Proceedings of the First International Conference, Fontana, Wisc., USA/23-26, Sep. 1991, pp. 269-274.

*Primary Examiner*—Deborah Yee

*Attorney, Agent, or Firm*—Senniger, Powers, Leavitt & Roedel

[57] ABSTRACT

The present invention is directed to air-meltable, tough alloys that are especially resistant to the abrasion and corrosion of wet-process phosphoric acid reactor fluids or slurries, especially those having a high fluoride ion concentration. The instant alloys consist of, by weight, about 22% to about 35% nickel, about 29% to about 35% chromium, about 2% to about 6% molybdenum, about 1% to about 4% copper, about 0.4% to about 1.2% carbon up to about 1.5% each of manganese and silicon and the balance essentially iron plus the usual minor impurities.

10 Claims, No Drawings

ABRASION AND CORROSION RESISTANT ALLOYS

This invention relates to nickel-chromium-iron alloys which have outstanding corrosion and abrasion resistance to wet-process phosphoric acid plant slurries, particularly where the slurries have a high fluoride ion concentration.

BACKGROUND OF THE INVENTION

In plants for the manufacture of wet-process phosphoric acid ground phosphate rock is reacted with sulfuric acid. The reactor slurries contain ground rock and typically, about 33% phosphorous pentoxide (45% phosphoric acid), 2–5% sulfuric acid, 1–3% fluorosilic acid, fluorosilicates and small amounts of chlorides and hydrofluoric acid. The operating temperature is typically about 80° C. As a result of these conditions of operation the reactor slurries are quite abrasive as well as exceedingly corrosive to metals.

In wet-acid plants castings need to be resistant to the corrosiveness and abrasiveness of the reactor slurries. Typically, alloys for such service would be nickel-chromium-iron alloys containing significant amounts of carbon. However, because castings for pumps and other equipment are often of several tons weight and several inches section thickness, various difficulties are encountered in the foundry when attempting to remove the gates and risers from such large and heavy section castings. One of these difficulties is due to the fact that high chromium alloys cannot be cut with oxyacetylene cutting torches. Another problem is due to the fact that very large risers are required to feed heavy, massive castings during the freezing stage but, at present, sufficiently large and maneuverable cutting wheels to remove such large risers are unavailable. Also, removing very large risers from any brittle alloys by cutting with an arc air torch tends to cause cracking in the castings starting at the riser neck unless the cutting is done very slowly. Another method of accomplishing riser removal has been to design the riser neck to have a notch or indentation ring of reduced diameter and to break the riser off with a blow from a sledge hammer, but this technique does not work for every casting design. Alternatively, the riser neck is notched by a fairly shallow ring cut with an arc air torch followed by breaking off the riser with a sledge hammer blow. However, either of these latter techniques may fail either due to cracking the casting or to a "break-in" at the casting area adjacent to the riser, that is, some portion of the casting volume itself adheres to the riser and thus leaves a void in the casting proper when the riser is removed. Therefore, for very large castings or for castings whose designs tend to cause "break-ins" some sacrifice of casting abrasion resistance, and therefore, reduced brittleness, is warranted in exchange for the ability to produce such castings in the foundry.

Furthermore, since silicon will react with fluorine most phosphoric acid wet-process plants attempt to minimize the highly corrosive free fluoride ion concentration by keeping a high silica to fluoride ion ratio in the reactor, usually by adding more silica sand. However, in some plant operations and with some phosphate rock deposits this is not always accomplished, in which case free fluoride ion, especially if above a concentration of about 2000 ppm, readily attacks high silicon metallic alloys which, as noted above, are often employed because of their abrasion resistance in certain other applications.

Because of these various problems there remains a need for alloys which combine sufficient toughness for good founding properties and which have good abrasion and corrosion resistance to high fluoride ion-containing wet-process phosphoric acid reactor slurries.

SUMMARY OF THE INVENTION

Among the several objects of the present invention, therefore, may be noted the provision of alloys having good resistance to the corrosive and abrasive attack of high free fluoride ion content wet-process phosphoric acid reactor slurries; the provision of such alloys that have an austenitic matrix and have sufficient ductility, toughness and resistance to thermal shock to withstand riser removal by arc air torch or similar high heat input methods; the provision of such alloys that may be readily machined; and the provision of such alloys that may be easily melted and cast in air.

Briefly, therefore, the present invention is directed to air-meltable, tough alloys that are especially resistant to the abrasion and corrosion of wet-process phosphoric acid reactor fluids or slurries, especially those having a high fluoride ion concentration. The instant alloys consist of, by weight, about 22% to about 35% nickel, about 29% to about 35% chromium, about 2% to about 6% molybdenum, about 1% to about 4% copper, about 0.4% to about 1.2% carbon up to about 1.5% each of manganese and silicon and the balance essentially iron plus the usual minor impurities.

DESCRIPTION OF THE PREFERRED EMBODIMENT

In accordance with the invention, alloys are provided which combine excellent abrasion and corrosion resistance to wet-process phosphoric acid reactor slurries with good founding properties. To achieve those properties the instant alloys have an austenitic matrix containing carbides, primarily chromium carbides. Thus, the chromium content is limited to a maximum of about 35% by weight and the carbon content of the alloys of the invention is chosen so that the mass content of the carbides in the alloys ranges from about 6% to about 18% by weight, and preferably between about 8% and about 14%, of the total alloy mass. This result is accomplished by having a carbon content in the alloys between about 0.4% and about 1.2%, preferably between about 0.6% and about 0.9% for the best abrasion resistance. At 1.2% carbon content the alloys of the invention have about 0.5% to about 1.5% elongation and therefore may also be employed to produce relatively light, thin section castings. However, for heavier castings an upper carbon limit of about 0.9% is preferred because it provides alloys having tensile elongations between about 1% and 4%, usually on the order of 2.5% which is sufficient to avoid cracking in riser necks, corners, etc.

Alloys of the invention having the minimum carbon level of about 0.4% have tensile elongations between about 6% and 20%, usually about 12%, but contain lower carbide mass than the optimum preferred range for best abrasion resistance to phosphoric acid reactor slurries. On the other hand, a minimum of about 0.6% carbon results in about 3% to about 9% tensile elongation and about 9% to 10% carbide mass by weight in the alloys. It has also been found that castings of about 2% to 10% tensile elongation but typically between about 3% and 6% tensile elongation, may be readily freed of gates and risers in the foundry, without causing thermal cracking by ordinary arc air torch or other usual methods and ground by abrasive wheels after the riser or gate pads have been removed.

For optimum resistance to wet-process phosphoric acid reactor slurries, and particularly those of high fluoride ion content, the alloys of the invention should contain a maximum of 1.5% of each of manganese and silicon. Minimums of about 29% chromium and about 2% molybdenum have also been found desirable. For purposes of assuring the required austenitic structure of alloys of the invention, chromium and molybdenum contents are limited to maximums of about 35% and 6% respectively. I have also found that for alloys of the invention a minimum of about 20% nickel is required in order to maintain an austenitic matrix and provide good corrosion resistance.

Accordingly, primary components of the alloys of the invention are:

| | |
|---|---|
| CARBON | 0.4 to 1.2% BY WEIGHT |
| NICKEL | 20 TO 35% |
| CHROMIUM | 29 to 35% |
| MOLYBDENUM | 2 TO 6% |
| COPPER | 1 TO 4% |
| SILICON | UP TO 1.5% |
| MANGANESE | UP TO 1.5% |
| IRON | ESSENTIALLY THE BALANCE |

For large castings or for any other situations, such as "spidery" or box-like designs with tee-joints, x-joints, etc., in which toughness and ductility are required in order to produce such castings successfully, the preferred alloys of the present invention are those having the following composition:

| | |
|---|---|
| CARBON | 0.6 to 0.9% BY WEIGHT |
| NICKEL | 25 TO 34% |
| CHROMIUM | 29 to 33% |
| MOLYBDENUM | 3 TO 5% |
| COPPER | 2 TO 4% |
| SILICON | UP TO 1% |
| MANGANESE | UP TO 1% |
| IRON | ESSENTIALLY THE BALANCE |

The invention is further illustrated by the following examples.

EXAMPLE 1

Heats of several different alloys were prepared in accordance with the invention. Tensile test bar blanks and corrosion test blocks of each alloy measuring 2.5 inches long by 1.25 inches wide by 0.4 inch thick were cast in dry sand molds from each heat. The composition of these alloys is set forth in Table I, with the balance in each case being essentially iron plus the usual impurities.

TABLE 1

COMPOSITIONS OF ALLOYS OF THE INVENTION WEIGHT PERCENTAGES

| ALLOY | C | Ni | Cr | Mo | Cu | Si | Mn |
|---|---|---|---|---|---|---|---|
| 1 | 0.47 | 33.13 | 29.12 | 3.03 | 3.25 | 0.62 | 0.78 |
| 2 | 0.52 | 30.51 | 29.98 | 3.53 | 3.57 | 0.59 | 0.46 |
| 3 | 0.61 | 29.55 | 31.02 | 4.21 | 3.16 | 0.57 | 0.66 |
| 4 | 0.69 | 26.49 | 31.21 | 3.11 | 2.79 | 0.73 | 0.33 |
| 5 | 0.80 | 26.03 | 32.03 | 3.50 | 2.87 | 0.62 | 0.57 |
| 6 | 0.92 | 25.12 | 32.26 | 3.07 | 3.02 | 0.45 | 0.86 |
| 7 | 0.99 | 24.02 | 33.03 | 3.20 | 3.49 | 0.39 | 0.79 |

Using the as cast, non-heat treated standard physical test blocks of each heat, standard tensile test bars were machined and the mechanical properties of each alloy at room temperature were measured. The results of these measurements are set forth in Table II.

TABLE II

MECHANICAL PROPERTIES OF THE ALLOYS OF THE INVENTION

| ALLOY NO. | TENSILE STRENGTH P.S.I. | YIELD STRENGTH P.S.I. | TENSILE ELONGATION % | BRINELL HARDNESS NUMBER |
|---|---|---|---|---|
| 1 | 69,800 | 38,600 | 13.7 | 215 |
| 2 | 70,200 | 39,100 | 10.7 | 215 |
| 3 | 68,500 | 38,400 | 6.2 | 228 |
| 4 | 67,900 | 37,300 | 5.1 | 238 |
| 5 | 70,000 | 38,900 | 4.0 | 246 |
| 6 | 72,600 | 39,400 | 3.5 | 259 |
| 7 | 71,500 | 39,200 | 3.0 | 271 |

EXAMPLE 2

Test blocks as prepared in Example 1, in the as cast condition, were immersed in 600 ml beakers containing a solution of 65% phosphoric acid, 3.5% sulfuric acid and 0.5% (5000 ppm) sodium chloride in water at various temperatures. That solution is on the high end of the range of chlorides and sulfuric acid typically found in wet-acid reactor solutions. The blocks were supported on one end by a bed of half-inch diameter glass marbles and on the other end by the side of the beaker so that all faces were in contact with the solution. Inasmuch as hydrofluoric acid attacks glass, and these tests were conducted in glassware, that acid was not added to the test solution. However, field tests in commercial wet-acid reactors have demonstrated that for low silicon content alloys of the prior art the corrosion of such alloys at 100° C. due to chloride ion can be related to the corrosion due to fluoride ion. More specifically, it has been found that for chloride ion concentrations higher than about 50–1000 ppm that each 750 ppm increase in chloride ion concentration is equivalent to about 800 ppm free fluoride. In the case of sulfuric acid, it is similarly been found that at 85° C. for a corrosion rate of 0.5 mm/yr. (20 m/yr) a 1% increase in excess sulfuric acid gives the same rate of attack as an increase in free fluoride ion concentration of about 1000 ppm. Each test block was weighed to the nearest 1,000th of a gram before and after the immersions and the weight loss was converted to a figure of average depth of corrosion penetration in mils per year (MPY), in accordance with the relationship:

$$MPY = 303.7 \frac{Wo - Wf}{ATD}$$

where

Wo=ORIGINAL WEIGHT OF SAMPLE

Wf=FINAL WEIGHT OF SAMPLE

A=AREA OF SAMPLE IN SQUARE CENTIMETERS

T=DURATION OF THE TEST IN YEARS

D=DENSITY OF THE ALLOY IN GRAMS PER CUBIC CENTIMETER

The results of these tests are set forth in Table III.

TABLE III

WEIGHT LOSS IN SULFURIC ACID-CHLORIDE TEST SOLUTIONS, MPY

| TEMPERATURE | ALLOY NO. | | | | | | |
|---|---|---|---|---|---|---|---|
| °C. | 1 | 2 | 3 | 4 | 5 | 6 | 7 |
| 80 | 2.3 | 1.7 | 1.3 | 2.1 | 1.5 | 1.6 | 2.1 |
| 90 | 3.8 | 4.3 | 2.4 | 4.6 | 2.6 | 3.9 | 3.4 |
| 100 | 8.8 | 8.2 | 7.8 | 9.7 | 8.1 | 9.3 | 9.0 |
| 110 | 13.8 | 13.2 | 11.9 | 14.1 | 12.2 | 12.2 | 11.4 |
| 120 | 21.0 | 20.6 | 18.7 | 22.1 | 18.8 | 19.6 | 19.3 |

Assuming a maximum allowable corrosion rate of about 20 MPY, which those working in the art accept as reasonable, the alloys of the invention showed relatively low attack at 80° to 90° C. and allowable attack up to almost 120° C.

While it might be expected that the relatively lower carbon content of the instant alloys would lower service life, especially at the low end of the range of carbon for those alloys, it is believed that from the above data and the performance of prior art alloys in a variety of abrasive and corrosive slurries that the alloys of the invention would have about twice the service life of prior art alloys. Thus, in instances in which higher carbon alloys are not suitable due either to casting mass, design or a need for greater casting toughness in service, the alloys of the invention are a great improvement over such alloys. In view of the above, it will be seen that the several objects of the invention are achieved.

Although specific examples of the present invention are provided herein, it is not intended that they are exhaustive or limiting of the invention. These illustrations and explanations are intended to acquaint others skilled in the art with the invention, its principles, and is practical application, so that they may adapt and apply the invention in its numerous forms, as may be best suited to the requirements of a particular use.

What is claimed is:

1. An alloy consisting of:

| | |
|---|---|
| CARBON | 0.4 to 1.2% BY WEIGHT |
| NICKEL | 20 TO 35% |
| CHROMIUM | 29 to 35% |
| MOLYBDENUM | 2 TO 6% |
| COPPER | 1 TO 4% |
| SILICON | UP TO 1.5% |
| MANGANESE | UP TO 1.5% |
| IRON | THE BALANCE |

2. An alloy of claim 1 consisting of:

| | |
|---|---|
| CARBON | 0.6 to 0.9% BY WEIGHT |
| NICKEL | 25 TO 34% |
| CHROMIUM | 29 to 33% |
| MOLYBDENUM | 3 TO 5% |

-continued

| | |
|---|---|
| COPPER | 2 TO 4% |
| SILICON | UP TO 1% |
| MANGANESE | UP TO 1% |
| IRON | BALANCE |

3. An alloy of claim 1 consisting of:

| | |
|---|---|
| CARBON | 0.45 to 1% BY WEIGHT |
| NICKEL | 24 TO 34% |
| CHROMIUM | 29 to 33% |
| MOLYBDENUM | 3 TO 4.2% |
| COPPER | 2.8 TO 4% |
| SILICON | 0.4 TO 0.65% |
| MANGANESE | 0.3 TO 0.9% |
| IRON | BALANCE |

4. An alloy of claim 1 consisting of:

| | |
|---|---|
| CARBON | 0.4 to 0.6% BY WEIGHT |
| NICKEL | 30 TO 35% |
| CHROMIUM | 29 to 30% |
| MOLYBDENUM | 3 TO 3.6% |
| COPPER | 3 TO 3.6% |
| SILICON | 0.6 TO 0.65% |
| MANGANESE | 0.4 TO 0.8% |
| IRON | BALANCE |

5. An alloy of claim 1 consisting of:

| | |
|---|---|
| CARBON | 0.52% BY WEIGHT |
| NICKEL | 30.51% |
| CHROMIUM | 29.98% |
| MOLYBDENUM | 3.53% |
| COPPER | 3.57% |
| SILICON | 0.59% |
| MANGANESE | 0.46% |
| IRON | BALANCE |

6. An alloy of claim 1 consisting of:

| | |
|---|---|
| CARBON | 0.61 BY WEIGHT |
| NICKEL | 29.55% |
| CHROMIUM | 31.02% |
| MOLYBDENUM | 4.21% |
| COPPER | 3.16% |
| SILICON | 0.57% |
| MANGANESE | 0.66% |
| IRON | BALANCE |

7. An alloy of claim 1 consisting of:

| | |
|---|---|
| CARBON | 0.69% BY WEIGHT |
| NICKEL | 26.49% |
| CHROMIUM | 31.21% |
| MOLYBDENUM | 3.11% |
| COPPER | 2.79% |
| SILICON | 0.73% |
| MANGANESE | 0.33% |
| IRON | BALANCE |

8. An alloy of claim 1 consisting of:

| | |
|---|---|
| CARBON | 0.80% BY WEIGHT |
| NICKEL | 26.03% |
| CHROMIUM | 32.03% |
| MOLYBDENUM | 3.50% |
| COPPER | 2.87% |
| SILICON | 0.62% |
| MANGANESE | 0.57% |

-continued

| | |
|---|---|
| IRON | BALANCE |

9. An alloy of claim 1 consisting of:

| | |
|---|---|
| CARBON | 0.92% BY WEIGHT |
| NICKEL | 25.12% |
| CHROMIUM | 32.26% |
| MOLYBDENUM | 3.07% |
| COPPER | 3.02% |
| SILICON | 0.45% |
| MANGANESE | 0.86% |

-continued

| | |
|---|---|
| IRON | BALANCE |

10. An alloy of claim 1 consisting of:

| | |
|---|---|
| CARBON | 0.99% BY WEIGHT |
| NICKEL | 24.02% |
| CHROMIUM | 33.03% |
| MOLYBDENUM | 3.20% |
| COPPER | 3.49% |
| SILICON | 0.39% |
| MANGANESE | 0.79% |
| IRON | BALANCE |

* * * * *